US007965968B2

(12) United States Patent
Shihoh et al.

(10) Patent No.: US 7,965,968 B2
(45) Date of Patent: Jun. 21, 2011

(54) IMAGE FORMING APPARATUS

(75) Inventors: Makoto Shihoh, Yokohama (JP); Hiroshi Ito, Fuchu (JP); Yoshihiro Shigemura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/708,732

(22) Filed: Feb. 19, 2010

(65) Prior Publication Data

US 2010/0226696 A1 Sep. 9, 2010

(30) Foreign Application Priority Data

Mar. 4, 2009 (JP) ..... 2009-050429

(51) Int. Cl.
*G03G 15/01* (2006.01)

(52) U.S. Cl. ..... 399/301; 399/302

(58) Field of Classification Search ..... 399/116, 399/117, 159, 160, 297–302, 308
See application file for complete search history.

(56) References Cited

U.S. PATENT DOCUMENTS

| | | | | |
|---|---|---|---|---|
| 5,160,946 | A | 11/1992 | Hwang | |
| 5,534,984 | A * | 7/1996 | Inoue | 399/308 |
| 7,684,734 | B2 * | 3/2010 | Sato | 399/167 |
| 7,844,196 | B2 * | 11/2010 | Kita et al. | 399/107 |

FOREIGN PATENT DOCUMENTS

| | | |
|---|---|---|
| JP | 1-006981 | 1/1989 |
| JP | 5-241457 | 9/1990 |
| JP | 2004-145077 | 5/2004 |

* cited by examiner

*Primary Examiner* — Hoan Tran
(74) *Attorney, Agent, or Firm* — Fitzpatrick, Cella, Harper & Scinto

(57) ABSTRACT

The image forming apparatus includes a plurality of photosensitive members, a plurality of exposure portions to perform exposure on the plurality of photosensitive members, a development portion to form a toner image at the plurality of photosensitive members, a transfer medium to which the respective toner images formed on the plurality of photosensitive members are sequentially transferred so as to form an image, and a position correction portion to perform position correction by moving at least one photosensitive member among the plurality of photosensitive members, and the position correction of the photosensitive member is performed by swinging the photosensitive member by the position correction portion having a line on a circumference surface of the photosensitive member corresponding to an exposure position of the exposure portion as the center axis.

7 Claims, 12 Drawing Sheets

FIG. 7A
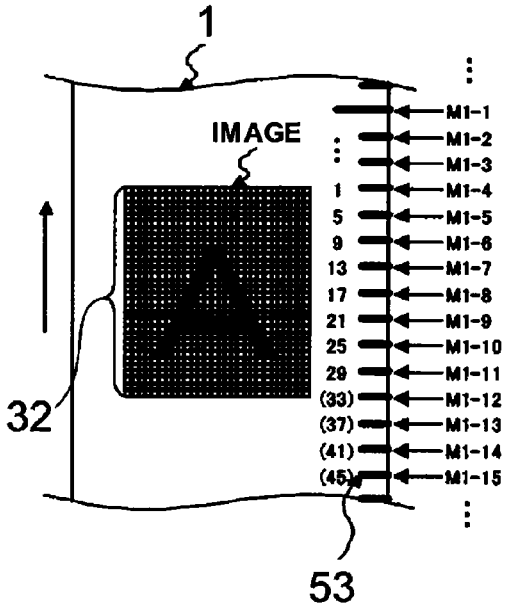
FIG. 7B
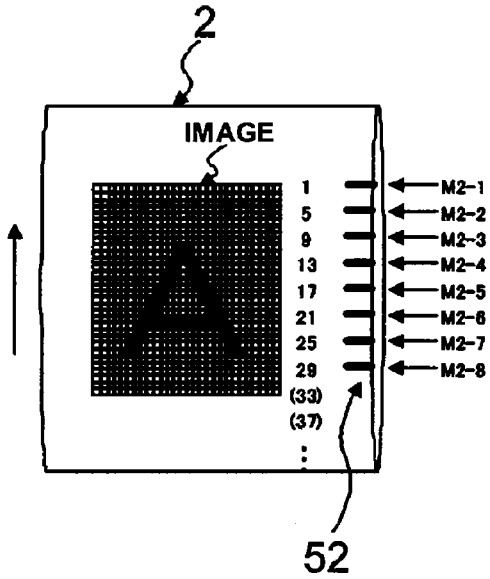
FIG. 7C
| LINE NUMBER OF IMAGE | GRADUATION NUMBER ON INTERMEDIATE TRANSFER BELT | GRADUATION NUMBER ON PHOTOSENSITIVE DRUM |
|---|---|---|
| 1 | M1-4 | M2-1 |
| 5 | M1-5 | M2-2 |
| 9 | M1-6 | M2-3 |
| 13 | M1-7 | M2-4 |
| 17 | M1-8 | M2-5 |
| 21 | M1-9 | M2-6 |
| 25 | M1-10 | M2-7 |
| 29 | M1-11 | M2-8 |

IMAGE FORMING APPARATUS

BACKGROUND OF THE INVENTION

1. Field of the Invention

The present invention relates to image forming apparatuses having a plurality of image forming portions, such as color printers and color copying machines. In particular, the present invention relates to an image forming apparatus which performs control of color shifting.

2. Description of the Related Art

In the related art, there has been image forming apparatuses which perform color shifting correction (e.g., see Japanese Patent Laid-open Nos. S64-6981, H5-241457, and 2004-145077).

In the image forming apparatus in accordance with Japanese Patent Laid-open No. S64-6981, a rewritable information writing portion is disposed respectively on each surface of a photosensitive drum and an intermediate transfer belt in the sub-scanning direction. The speed difference between the photosensitive drum and the intermediate transfer belt is detected by detecting information written in the information writing portions, and then, the rotation speed of the photosensitive drum is controlled in accordance with the speed difference. This is called a sampling correction method. This method is effective for shifting of the photosensitive drum fluctuating in a relatively long time due to temperature variation in the color image forming apparatus or due to external force applied to the apparatus.

However, in addition to the element which varies in a long time, color shifting includes an element which fluctuates in a short time to cause fluctuation of a rotation member. Such a color registration shifting element in a short time has not been a correction target of the sampling correction method in Japanese Patent Laid-open No. S64-6981. In other words, since correction is performed on the next image forming after detecting the color registration shifting of an image which was formed in the past, fluctuation in a short time cannot be corrected.

Japanese Patent Laid-open No. H5-241457 discloses the following technology. A visible image mark for position detection corresponding to original image information is formed at a first image forming portion. Subsequently, a detection signal is obtained by detecting the position detection mark which is transferred on the intermediate transfer belt. Writing operation timing of a second image forming portion is adjusted based on the detection signal.

In Japanese Patent Laid-open No. H5-241457, however, the position detection mark formed at the first image forming portion and transferred on the intermediate transfer belt thereafter is detected, and then, the wiring operation timing of the second image forming portion is adjusted based on the detection signal. Therefore, the fluctuation element generated within the period from the second image is formed at the second image forming portion until the second image is transferred to the intermediate transfer belt has not been detected and nor corrected.

In Japanese Patent Laid-open No. 2004-145077, the following technology is disclosed. A position information writing portion to write scales in the sub-scanning direction on respective surfaces of a photosensitive drum and an intermediate transfer belt is arranged. Speed difference between the photosensitive drum and the intermediate transfer belt is detected by detecting the scales written by the position information writing portion, and then, the rotation speed of the photosensitive drum is controlled in accordance with the speed difference. By writing a number of the information, detection of a fluctuation element in a short time has become possible and the color registration shifting has become possible to nearly be completely corrected.

However, when the color registration shifting is corrected by controlling the rotation speed of the photosensitive drum as disclosed in Japanese Patent Laid-open No. 2004-145077, such problems as described below occur.

For example, when the speed of the intermediate transfer belt is decreased, the rotation speed of the photosensitive drum is to be decreased. At that time, the position information writing portion writes the drum position information at constant time intervals on the photosensitive drum. Therefore, the space between the scales of the written drum position information becomes narrow.

Subsequently, even though the speed fluctuation of the intermediate transfer belt disappears once, the rotation speed of the photosensitive drum has to be decreased, in the case in which the speed of the intermediate transfer belt is decreased again when the drum position information arrives at a drum position reading portion. Accordingly, in this case, the space between the scales of the drum position information to be written on the photosensitive drum by the position information writing portion becomes narrower and narrower.

In this manner, the position correction control amount affects the movement correction control amount thereafter for each cycle of transferring from exposure. That is, the position correction control amount is accumulated when speed fluctuation continuously occurs. When the position correction amount is accumulated as described above, the position correction amount is oscillated with speed fluctuation of a specific frequency. There has been a problem that the position correction amount exceeds a position correction control range when the position correction amount is oscillated.

Measures for preventing position correction amount oscillation include one in which an image forming operation is completely stopped when the position control amount exceeds an established value. However, the complete stop of the image forming operation results in reduction in throughput of image forming.

A process of integrally moving an exposure portion and a photosensitive drum can also prevent the oscillation. However, since the mass of the exposure portion is large, high-speed fine move of the exposure portion integral with the photosensitive drum unavoidably results in the upsizing and higher cost of the movement mechanism.

SUMMARY OF THE INVENTION

The present invention provides an image forming apparatus capable of suppressing position shifting of an image without causing upsizing of the apparatus.

To address this issue, an image forming apparatus of the present invention includes the following. An image forming apparatus includes: a plurality of image forming portions respectively including a photosensitive member, an exposure device which performs scanning exposure on the photosensitive member, and a development device which develops with toner an electrostatic image formed at the photosensitive member by the exposure device; a transfer mechanism which transfer to an image receiving member by sequentially superimposing toner images formed at the plurality of image forming portions; and a swing mechanism which swings the photosensitive member having a main scanning line on the photosensitive member which is image-exposed by the exposure device substantially as the center axis at least at one of the image forming portions.

Further features of the present invention will become apparent from the following description of exemplary embodiments (with reference to the attached drawings).

BRIEF DESCRIPTION OF THE DRAWINGS

FIGS. 7A to 7C are views which illustrate an example of image position information according to the first embodiment;

DESCRIPTION OF THE EMBODIMENTS

Embodiments in accordance with the present invention will be described below with reference to the drawings.

First Embodiment

[General Overview of Image Forming Apparatus]

Figure 1:
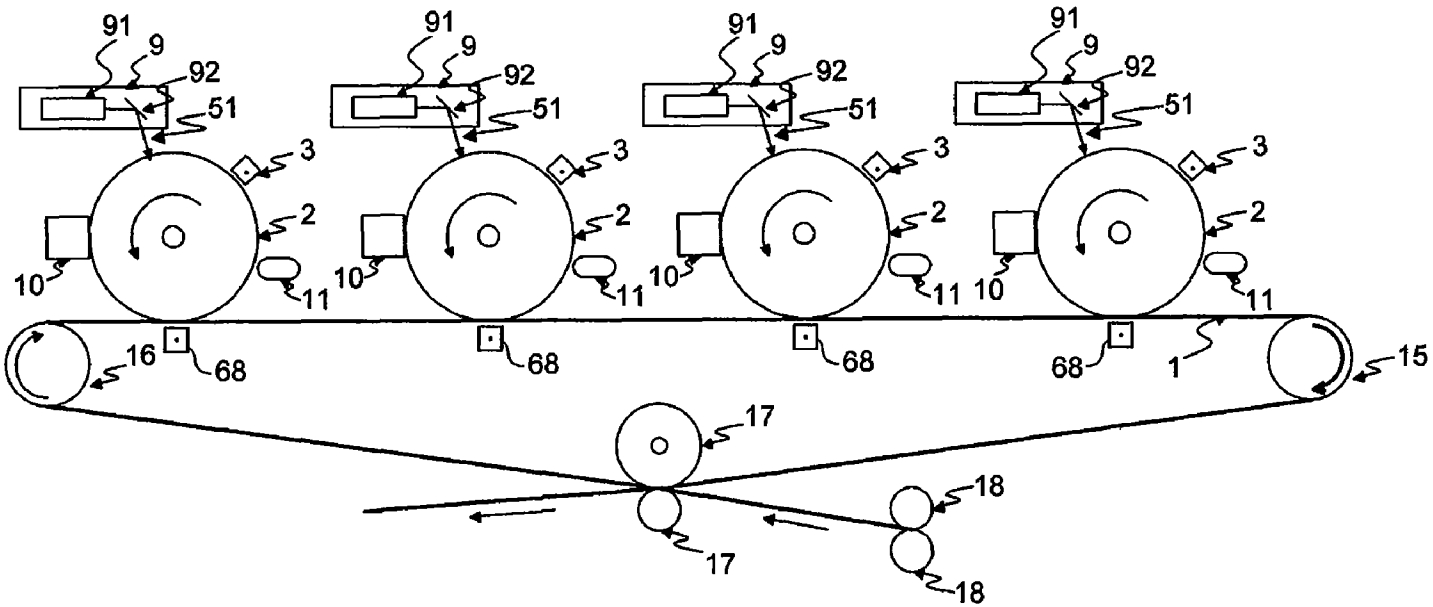
FIG. 1 is a schematic view of the entire configuration of an image forming apparatus according to the first embodiment.

FIG. 1 is a schematic view of the entire configuration of an image forming apparatus. As illustrated in FIG. 1, the image forming apparatus of the present embodiment is a color image forming apparatus of a tandem type having four photosensitive drums (i.e., photosensitive members).

The image forming apparatus according to the present embodiment includes an intermediate transfer belt 1 turning to move at constant speed and photosensitive drums 2 for respective four colors rotating at constant angular speed.

There are provided a primary charger 3, an exposure portion 9, a laser optical system 91, a reflection mirror 92, a development portion 10 and a cleaner 11 at the vicinity of the photosensitive drum 2. The exposure portion 9 also functions as a position information recording portion.

The intermediate transfer belt 1 is extended by a drive roller 15 and a driven roller 16. Further, at the intermediate transfer belt 1, a pair of secondary transfer rollers 17 are arranged at a secondary transfer portion at which an image is transferred to a recording medium such as plain paper. In addition, a pair of feeding rollers 18 are arranged at the upstream side in the conveying direction of the secondary transfer portion.

With the abovementioned configuration, image forming operation is performed in the following procedure.

First, a latent image is formed on the photosensitive member for each color of an image by utilizing the exposure portion 9 corresponding to each photosensitive drum 2. A toner image is formed by supplying toner from the development portion 10 to the formed latent image.

The toner images of four colors formed at the four photosensitive drums as described above are sequentially transferred (i.e., primarily transferred) on the intermediate transfer belt 1 to be superimposed, so that a color toner image is formed. The primary transfer is performed by a transfer charger 68.

The color toner image transferred to the intermediate transfer belt 1 is transferred (i.e., secondarily transferred) to a recording medium by the secondary transfer roller 17 and is fixed at a fixing portion (not illustrated). At that time, timing control to control recording start timing of the exposure portion is performed by a control portion (not illustrated) so as to align positions of toner images of respective colors on the intermediate transfer belt 1. With the abovementioned operation, a color image is recorded on a recording medium.

Figure 2:
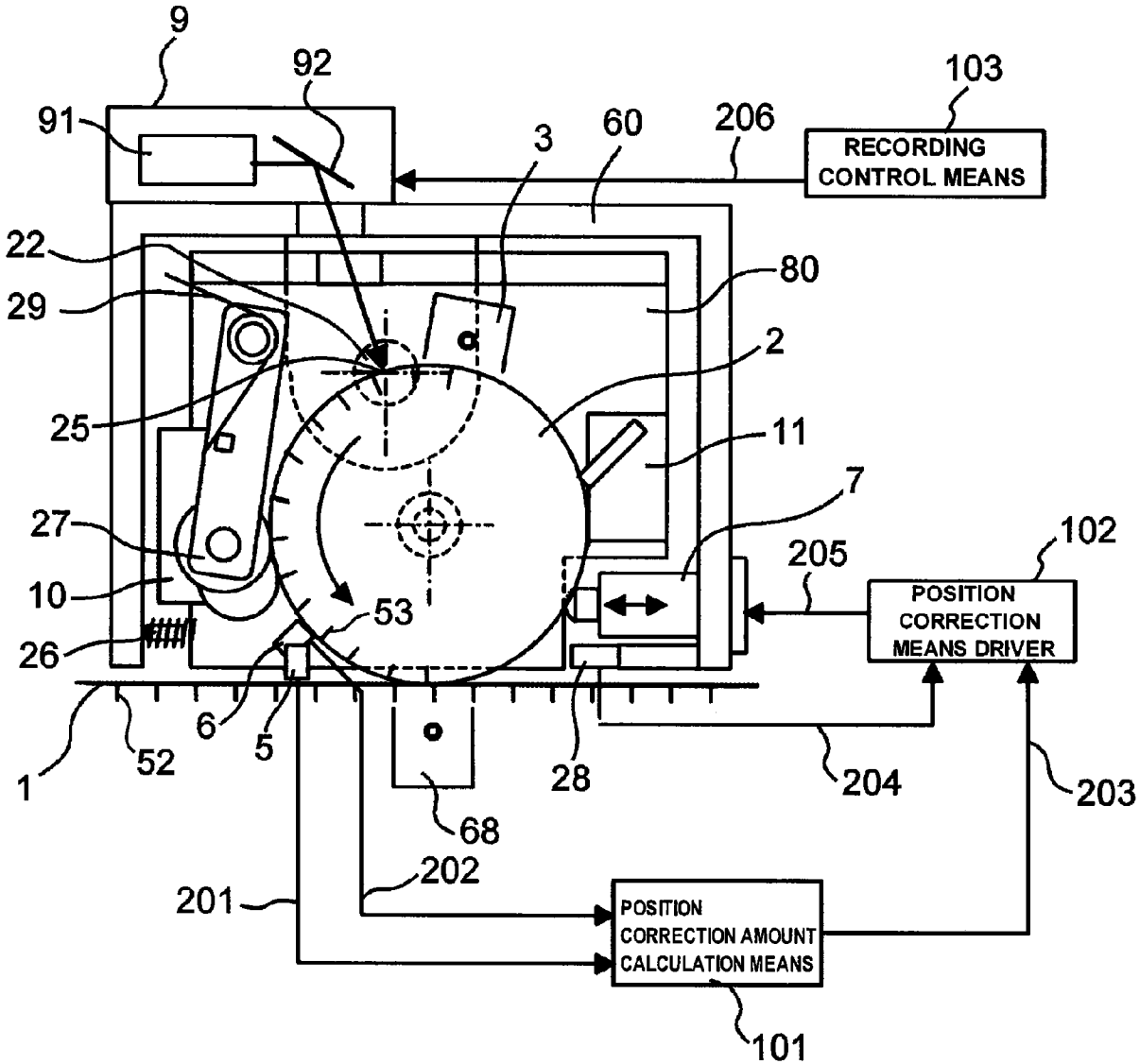
FIG. 2 is a sectional view of an image forming portion according to the first embodiment viewing from an end portion direction of a photosensitive drum.
Figure 3:
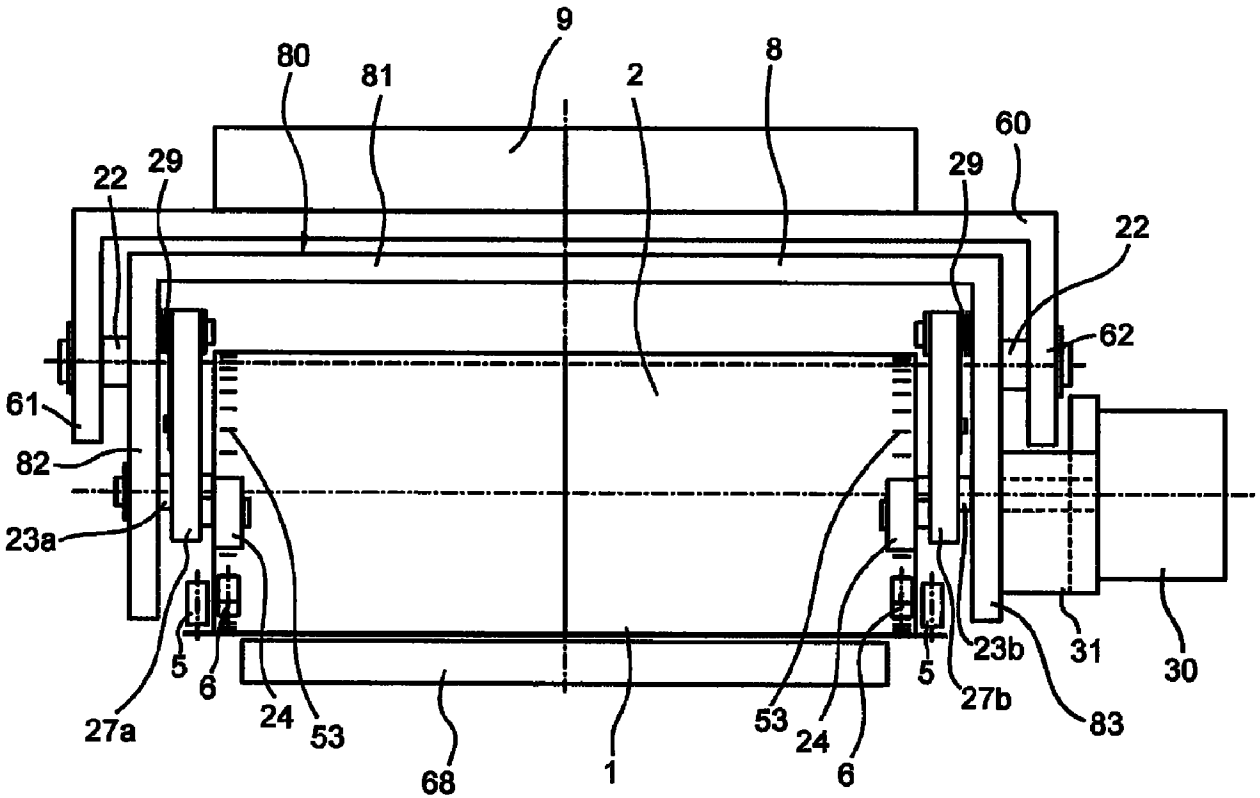
FIG. 3 is a side view of the photosensitive drum according to the first embodiment.

The specific configuration of the present embodiment will be described below with reference to FIGS. 2 and 3. FIG. 2 is a sectional view of the image forming portion of the first embodiment viewing from an end portion direction of the photosensitive drum 2. FIG. 3 is a side view of the photosensitive drum 2 viewing the photosensitive drum 2 from the upstream side in the conveying direction of the intermediate transfer belt 1. FIGS. 2 and 3 simply illustrate a range of a single photosensitive drum of the configuration of FIG. 1.

[Configuration of Position Information]

As illustrated in FIG. 2, position information is formed as described in the following respectively to the intermediate transfer belt 1 and the photosensitive drum 2.

First, belt position information 52 is formed at the end portion in the circumference direction of the intermediate transfer belt 1. The belt position information 52 is constituted with a plurality of scales arranged at constant intervals and one origin point mark indicating the origin point in the circumference direction.

Meanwhile, the photosensitive drum 2 rotating at constant angular speed includes drum position information 53. The drum position information 53 is constituted with a plurality of scales (i.e., graduations) formed at constant intervals at the end portion in the circumference direction.

[Configuration of Movable Portion Unit]

As illustrated in FIG. 2, the distinctive configuration of the present embodiment is that a movable portion unit 80 supporting the photosensitive drum 2 is supported to be capable of being swung below a fixed portion chassis 60 via a swing shaft 22.

The movable portion unit 80 is swung against the fixed portion chassis 60 having the swing shaft 22 as the center. In the movable portion unit 80, the photosensitive drum 2 is rotated having photosensitive drum shafts 23*a* and 23*b* as the center. In addition to the photosensitive drum 2, the movable portion unit 80 integrally retains process portions acting on the photosensitive drum 2, such as the primary charger 3, the development portion 10 and the cleaner 11.

As illustrated in FIG. 3, a case of the movable portion unit 80 is constituted at least with a movable portion upper chassis 81 located above the photosensitive drum 2, a movable portion left chassis 82 and a movable portion right chassis 83.

At the inner side of the movable portion left chassis 82 and the movable portion right chassis 83, the photosensitive drum shafts 23*a* and 23*b* are arranged respectively via a bearing (not illustrated). The photosensitive drum 2 is supported by the photosensitive drum shafts 23*a* and 23*b*.

A drum drive motor 30 to drive the photosensitive drum 2 is arranged at the movable portion right chassis 83 via a motor stand 31. The shaft of the drum drive motor 30 is coupled to the photosensitive drum shaft 23*b*.

Drum urging portions (i.e., urging portions) 27*a* and 27*b* are arranged at a position adjacent to the photosensitive drum 2 at the inside of the movable portion left chassis 82 and the movable portion right chassis 83. A roller 24 rotatably supported via a bearing (not illustrated) is arranged respectively at the top end side of the drum urging portions 27*a* and 27*b* and is contacted to the photosensitive drum 2. A torsion spring 29 is arranged respectively at the drum urging portions 27*a* and 27*b* at the opposite side to the roller 24. With this configuration, the roller 24 is continuously urged to the photosensitive drum 2.

Since the photosensitive drum 2 is continuously urged in one direction, effects of bearing looseness at the photosensitive drum 2 can be reduced. Accordingly, an even more accurate control can be actualized.

A swing shaft 22 is arranged respectively at the outer side of the movable portion left chassis 82 and the movable portion right chassis 83.

As illustrated in FIG. 2, the swing shaft 22 is supported by the fixed portion chassis 60 having an approximate U-shape. Specifically, the swing shaft 22 is rotatably supported via a bearing (not illustrated) respectively by a fixed portion left chassis 61 and a fixed portion right chassis 62 which are bilaterally arranged at the fixed portion chassis 60.

The exposure portion 9 is supported and fixed on the fixed portion chassis 60. Further, the fixed portion chassis 60 is supported and fixed to an apparatus case (not illustrated).

The swing shaft 22 is disposed so that the center axis thereof is aligned to the scanning locus position of the surface of the photosensitive drum 2 with laser light 51 irradiated from the exposure portion 9, namely, aligned to the extension line of an exposure position 25.

[Configuration for Position Correction]

The configuration of a position correction portion 7 as a drive portion to drive the movable portion unit 80 and peripherals thereof will be described below.

As illustrated in FIG. 2, the fixed portion chassis 60 is provided with a pair of position correction portions 7. The position correction portions 7 are to be the drive portion to drive the movable portion unit 80. The movable portion unit 80 is driven by respectively pushing the movable portion left chassis 82 or the movable portion right chassis 83 with the position correction portion 7.

A compression spring 26 to urge the movable portion unit 80 toward the position correction portion side is arranged at a position opposed to the position correction portion 7 while sandwiching the movable portion unit 80.

A position detection portion 28 is disposed at the bottom end of the fixed portion chassis 60 below the position correction portion 7. The position detection portion 28 detects the position of the movable portion unit 80 against the fixed portion chassis 60. A non-contact fine displacement sensor is preferable as the position detection portion 28. For example, an eddy current type displacement sensor or a laser type displacement sensor can be adopted.

The position correction portion 7 controls movement of a heavy member such as the movable portion unit 80 of the present embodiment finely at the accuracy of micron or submicron. Therefore, a linear drive type actuator such as a lamination type piezoelectric actuator and a voice-coil type linear actuator is appropriate. Particularly, a lamination type piezoelectric actuator utilizing the piezoelectric effect is capable of performing fine position control with large load while the maximum movement amount is small. Since the position correction amount in the present embodiment is in the order of ±0.1 mm, the maximum movement amount being a weak point of a lamination type piezoelectric actuator does not cause any problem. Two pieces of lamination type piezoelectric actuators are utilized for the position correction portions 7 by respectively being arranged to both sides of the movable portion unit 80 and performing fine movement control.

In the case of utilizing a piezoelectric actuator as the position correction portion 7, there is hysteresis with the displacement amount against the drive voltage of the piezoelectric actuator. Accordingly, the present embodiment includes a circuit to feedback position information 204 detected by the position detection portion 28 as described above to a position correction portion driver 102. In this manner, accurate position correction can be performed.

[Reading of Position Information]

The configuration and method of reading of position information formed at the intermediate transfer belt 1 and the photosensitive drum 2 will be described below.

As illustrated in FIGS. 2 and 3, a belt position reading portion 5 and a drum position reading portion 6 are arranged between the intermediate transfer belt 1 and the photosensitive drum 2. The belt position reading portion 5 reads the belt position information 52 formed at the intermediate transfer belt and the drum position reading portion 6 reads the drum position information 53 formed at the photosensitive drum 2.

Both of the belt position reading portion 5 and the drum position reading portion 6 are supported and fixed to the apparatus case (not illustrated). The belt position reading portion 5 is arranged respectively to both of outer sides in the longitudinal direction of the photosensitive drum 2.

The belt position information 52 may be a binary magnetic pattern written by a magnetic head for writing (not illustrated) or may be a pattern having ranges of different reflectance previously formed at the intermediate transfer belt 1. As the belt position reading portion 5, a magnetic head for reproducing is appropriate for the former case of the binary magnetic pattern and a reflection type optical sensor is appropriate for the latter case of the different reflectance range pattern.

The drum position information reading portion reads the drum position information 53. The drum position information 53 is recorded by the exposure portion 9 as a latent image on the photosensitive drum 2. Accordingly, a potential sensor to detect presence of electric charge on the surface of the photosensitive drum 2 is utilized.

[Method of Transfer Position Correction]

A method of transfer position correction against speed fluctuation of the intermediate transfer belt 1 will be described below.

In FIG. 2, timing information of detecting the belt position information 52 by the belt position information reading portion 5 is to be belt timing information 201. Meanwhile, timing information of detecting drum position information 53 by the drum position reading portion 6 is to be drum timing information 202.

The belt timing information 201 and the drum timing information 202 are transmitted to a position correction calculation portion 101. The position correction calculation portion 101 calculates a shifting amount in accordance with time difference between mutual timings and outputs the shifting amount as a distance. The converted shifting amount is transmitted to a position correction portion driver 102 as a position correction amount 203.

The position correction portion driver 102 drives the position correction portion 7 while performing feedback of the position information 204 detected by the position detection portion 28. The position correction portion 7 swings the movable portion unit 80 in accordance with the shifting amount (i.e., the distance) of the position correction amount 203.

When the movable portion unit 80 is swung having the swing shaft 22 as the center, the transfer portion of the photosensitive drum 2 is moved to the upstream side of the intermediate transfer belt 1 (i.e., the left direction in FIG. 2). Accordingly, the belt position information 52 at the delaying intermediate transfer belt 1 side and the drum position information 53 of the photosensitive drum 2 side can be aligned.

Specific control procedure with this configuration will be described on the condition that the scales indicating the belt position information 52 of the intermediate transfer belt 1 are to be formed at constant intervals. In addition, the photosensitive drum 2 is to be complete round without decentering and is rotated at constant angular speed. Further, it is assumed that the exposure portion 9 forms the scales indicating the drum position information 53 at constant intervals.

On the abovementioned condition, when the intermediate transfer belt 1 has no speed fluctuation, there is no shifting between the belt timing information 201 and the drum timing information 202. Accordingly, the position correction is not performed.

When the speed of the intermediate transfer belt 1 is decelerated, the belt timing information 201 indicating passing timing of the intermediate transfer belt 1 side is delayed against the drum timing information 202 indicating passing timing of the photosensitive drum 2 side. Accordingly, the position correction calculation portion 101 converts the shifting amount of time difference between the mutual timings into the distance and transmits to the position correction portion driver 102 as the position correction amount 203.

Figure 4:
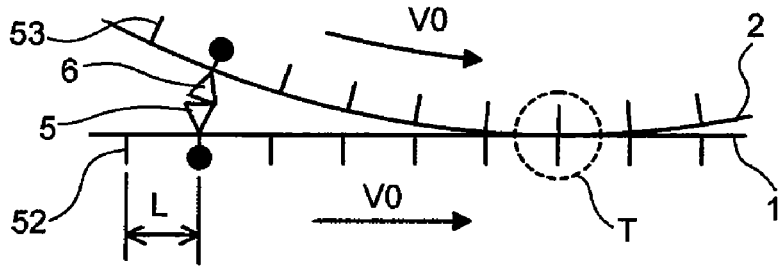
FIG. 4 is a schematic view which illustrates the state in which positions of belt position information and drum position information are aligned.

FIG. 4 is a schematic view in a state that positions of the belt position information 52 and the drum position information 53 as two pieces of image position information are aligned. Here, the interval in respective image position information is L, the movement speed of the intermediate transfer belt 1 is V0 and the angular speed of the photosensitive drum 2 is V0 as well.

When the belt position reading portion 5 and the drum position reading portion 6 respectively detect the corresponding image position information simultaneously, respective image position information are aligned at the transfer position as well. In this case, the position correction is unnecessary.

Figure 5A:
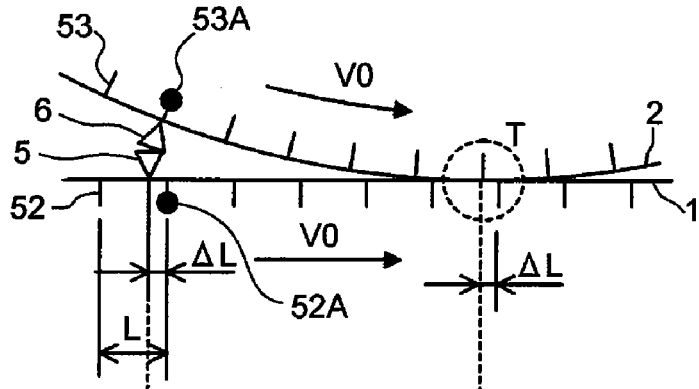
FIGS. 5A to 5C are schematic views which illustrate positions of the belt position information and the drum position information.
Figure 5B:
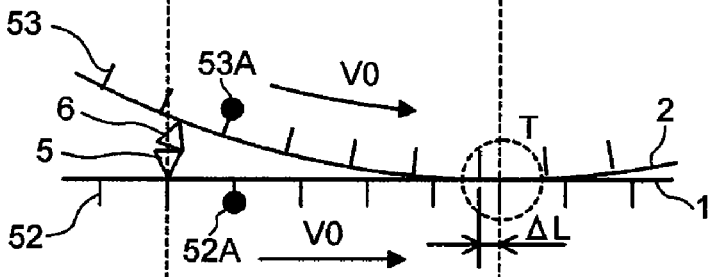
Figure 5C:
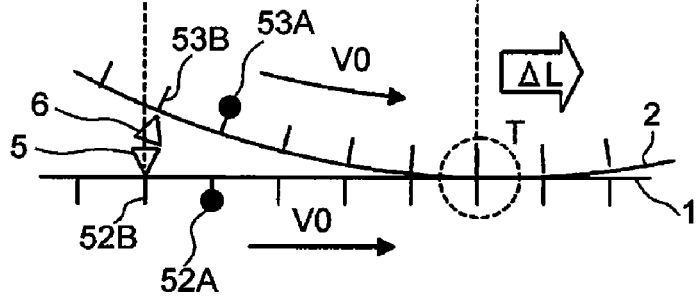

FIGS. 5A to 5C are schematic views illustrating positions of the belt position information 52 and the drum position information 53.

FIG. 5A is a schematic view indicating a state that the belt position information 52 and the drum position information 53 are not aligned. Here, the case in which the movement speed of the intermediate transfer belt 1 becomes larger than V0 at the last minute is described.

In this case, at instant of detecting a target drum position information 53A by the drum position reading portion 6, a corresponding target belt position information 52A has passed over the position of the belt position reading portion 5 by a distance of ΔL. Accordingly, the image position information at the transfer position T is shifted by the distance ΔL as well.

FIG. 5B is a schematic view indicating a state of the instant of detecting the next belt position information 52 of the intermediate transfer belt side by the belt position reading portion 5 without performing the position correction from the state of FIG. 5A.

In this case, since the intermediate transfer belt 1 is moved only by a distance of L-ΔL from the state of FIG. 5A, the photosensitive drum 2 is rotated only by the amount of the distance of L-ΔL as well. Accordingly, the image position information remains shifted by the distance ΔL at the transfer position T.

FIG. 5C is a schematic view indicating a state of the instant of detecting the next belt position information 52 of the intermediate transfer belt side by the belt position reading portion 5 with performing the position correction on the state of FIG. 5A.

In this case, although the photosensitive drum 2 is rotated only by the amount of the distance of L-ΔL from the state of FIG. 5A, the photosensitive drum is moved to the right side by the amount of the distance ΔL by the position correction portion 7. Accordingly, the image position information is aligned at the transfer position T.

At that time, the belt position reading portion 5 and the drum position reading portion 6 simultaneously read the next corresponding belt position information 52B and drum position information 53B. In this manner, aligning of the image at the transfer position T may be confirmed.

[Flow of Position Correction Control]

Figure 6:
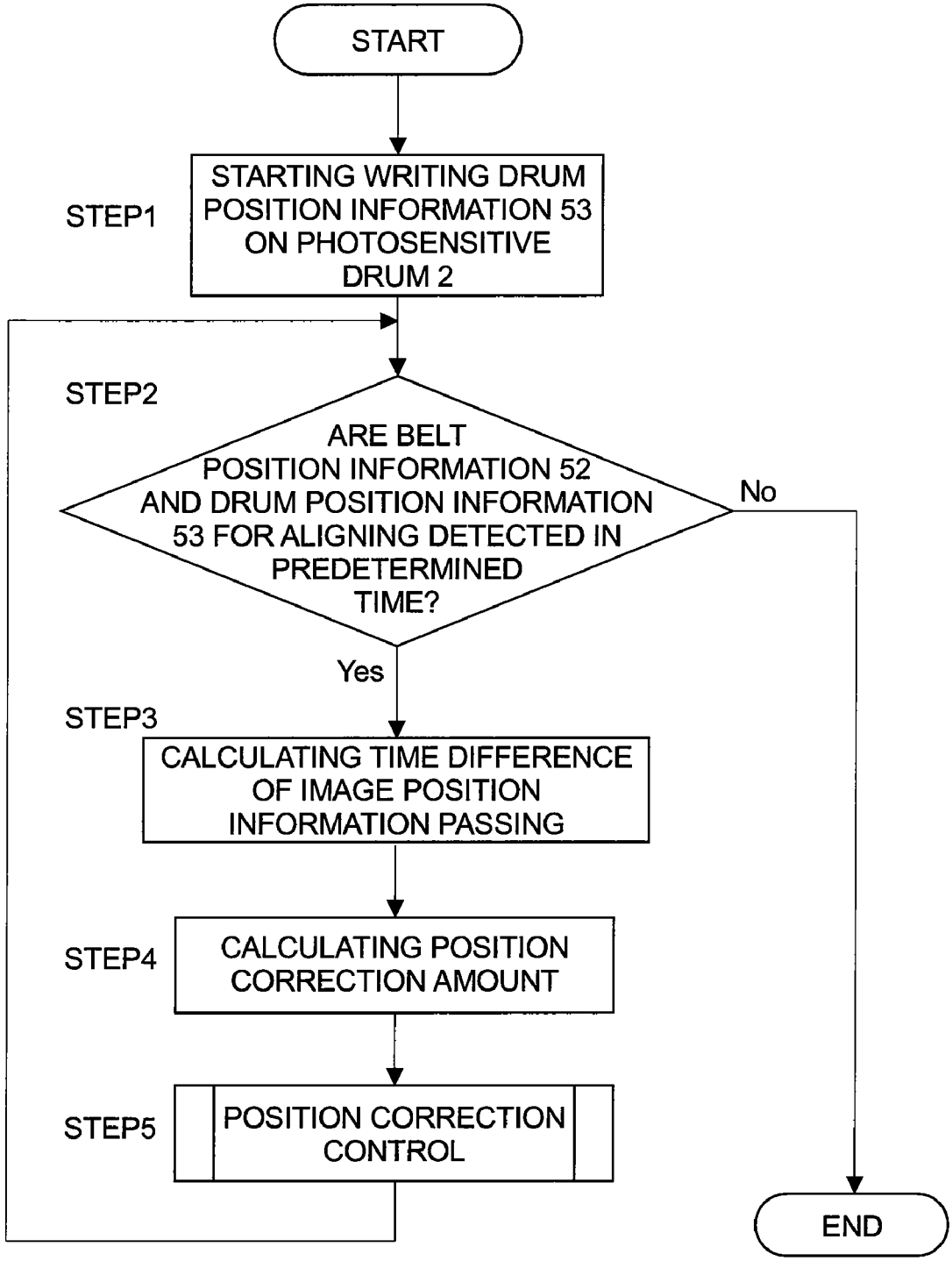
FIG. 6 is a flowchart which describes process flow of the first embodiment.

FIG. 6 is a flowchart describing process flow of the first embodiment.

First, writing of the drum position information 53 corresponding to an image is started to the photosensitive drum 2 (STEP 1).

Next, detection of the belt position information 52 by the belt position reading portion 5 and detection of the drum position information 53 by the drum position reading portion 6 are to be performed.

When the two pieces of position information 52 and 53 to be aligned are detected in a predetermined time (STEP 2), the difference between passing time of the belt position information 52 and passing time of the drum position information 53 is calculated (STEP 3).

The position correction amount 203 is calculated from the above calculated value so as not to be shifted (i.e., so as to be aligned) at the transfer position T (STEP 4).

Then, the position correction control is performed by driving the position correction portion 7 by the position correction portion driver 102 in accordance with the position correction amount 203 (STEP 5). Subsequently, the processes from STEP 2 to STEP 5 are repeated on the following image position information. In the case that the image position information is not detected in the predetermined time in STEP 2, the image recording is determined to be completed and the procedure is ended.

In the method of the transfer position correction against speed fluctuation of the intermediate transfer belt 1 of the present embodiment, the photosensitive drum 2 is controlled to be swung against the speed fluctuation of the intermediate transfer belt 1. As a result, the surface speed of the photosensitive drum 2 can be equaled to the speed of the intermediate transfer belt 1. By performing the position control as described above, the transfer position of the photosensitive drum 2 is moved. However, the relative position relation between the transfer position of the photosensitive drum 2 and the transfer position of the intermediate transfer belt 1 is not varied as a result of the position aligning control.

The distinctive configuration of the present embodiment is that the position correction of the photosensitive drum 2 is performed by swinging the photosensitive drum 2 by the position correction portion 7 as the center axis thereof being a line on the circumferential surface of the photosensitive drum corresponding to the exposure position 25 of the exposure portion 9. That is, the surface speed at the transfer position of the photosensitive drum 2 is varied by slightly rotating the photosensitive drum 2 due to the swinging. This is different from the configuration in the prior art to vary the surface speed at the transfer position of the photosensitive drum by the rotation control of the photosensitive drum, namely, by superimposing slight rotation for the position correction onto the constant angular speed rotation of the photosensitive drum.

By the way, the transfer position T of the photosensitive drum 2 is moved for the position correction. The amount is in the order of ±0.1 mm as described above. Meanwhile, an image forming apparatus of an electrophotographic system normally has a transfer range in the order of several millimeters in the conveying direction of the intermediate transfer belt 1. Accordingly, harmful effect does not appear especially on an image even in the case of movement of ±0.1 mm among several millimeters.

In the above, the position correction control is described for a single photosensitive drum 2. However, the position correction control is to be performed for all of the photosensitive drums 2 of four colors. Specifically, the belt position information 52 is previously formed on the intermediate transfer belt 1 at constant intervals, and then, the drum position information 53 is formed at the photosensitive drums 2 of four colors (i.e., black Bk, cyan C, magenta M and yellow Y). Then, the control is performed on each of the four photosensitive drums 2. In this manner, accurate aligning of images transferred from respective photosensitive drums 2 can be performed.

FIGS. 7A to 7C are views illustrating an example of the image position information of the first embodiment.

FIG. 7A illustrates the belt position information 52 formed on the intermediate transfer belt 1. The belt position information 52 is formed of graduations having linear scales located at constant intervals at the end portion of the intermediate transfer belt 1 in the circumference direction. One of the graduations is formed long so as to indicate the origin point of one turn of the intermediate transfer belt 1. Here, instead of varying a graduation length, it is also possible to adopt a method of varying a width in the circumference direction or varying a distance between adjacent graduations as the method to indicate the origin point.

The graduations are previously numbered sequentially in the increasing order having the graduation of the origin point as number 1. In FIG. 7A, "M1-" is placed at the front of each number in order to distinguish from graduation numbers of the drum side. Thus, such a number is to be as M1-1, M1-2, M1-3, etc.

The graduations of the belt position information 52 are not necessarily formed for respective lines of an image in the sub-scanning direction. In the present embodiment, one graduation is formed for every four lines as an example. In the example of FIG. 7A, the top end of an image of thirty-two lines is allocated to the graduation of M1-4. The position aligning control of each photosensitive drum is performed after allocating previously as this example.

As described later in another embodiment, it is also possible to perform the allocation at the time of transferring of the first photosensitive drum and to perform the position aligning control of the photosensitive drums of the second and later in accordance with the number which is allocated at the time of transferring of the first photosensitive drum.

FIG. 7B illustrates the drum position information 53 formed at the photosensitive drum 2. At the time of image exposure, linear scale graduations are formed at the end portion of the photosensitive drum 2 for every four lines from the top end of the image.

The graduation numbers are allocated in the increasing order starting from one. In order to distinguish from graduation numbers of the belt side, "M2-" is placed at the front of each number. Thus, such a number is to be as M2-1, M2-2, M2-3, etc.

FIG. 7C indicates the relation of the graduation numbers of the intermediate transfer belt 1 side and the photosensitive drum 2 side against respective lines allocated to the image for every four lines from line number 1 which is the top end line.

For the first line of the image, the graduation number of the intermediate transfer belt 1 side is to be M1-4 and the graduation number of the photosensitive drum 2 side is to be M2-1.

The reading portion in the vicinity of the transfer position, the graduation number is calculated while memorizing passing time of each graduation. The graduation numbers of the intermediate transfer belt 1 side are obtained by counting-up from the origin point as being M1-1, M1-2, etc.

Meanwhile, the graduation numbers of the photosensitive drum 2 side are obtained by counting-up as the firstly detected graduation being M2-1 and subsequent graduations being M2-2, M2-3, etc. With the passing time and the graduation numbers obtained as described above, the photosensitive drum 2 is swung so that the graduations having the same line number simultaneously pass through the transfer position. For example, in the case of aligning the graduations of line number 1, the photosensitive drum 2 is swung so that the graduations of M1-4 and M2-1 are not to be shifted at the transfer position.

Figure 8:
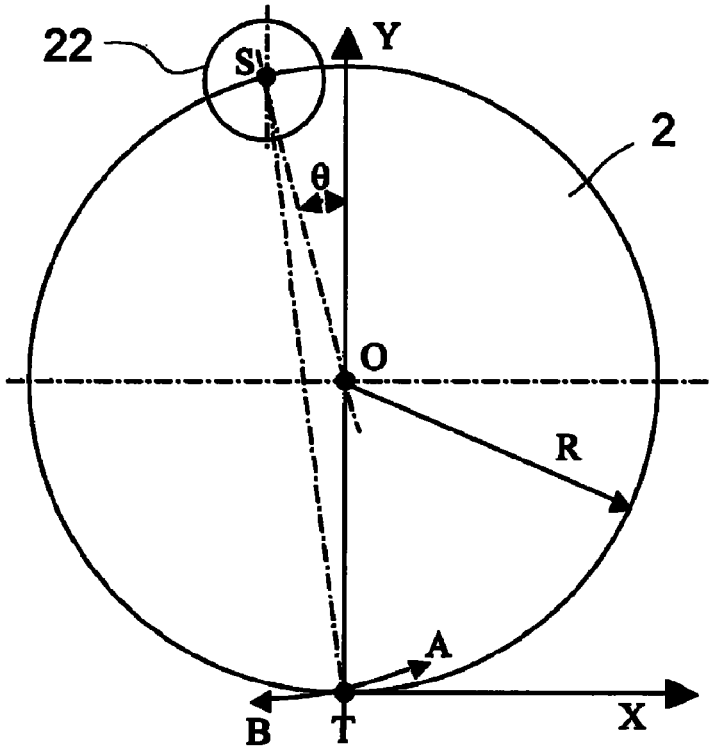
FIG. 8 is an explanatory view for vertical movement of a transfer position.

Next, the vertical movement amount of the transfer position when the photosensitive drum 2 is rotated having the swing shaft 22 as the center will be described with reference to FIG. 8. FIG. 8 is an explanatory view for the vertical movement of the transfer position T.

When the photosensitive drum 2 is finely swung having the swing shaft 22 as the center, the transfer position T at which a toner image formed on the photosensitive drum 2 is transferred to the intermediate transfer belt 1 is moved toward arrow A or arrow B in FIG. 8. Here, the transfer position T is moved in direction Y of FIG. 8 as well as in the conveying direction of the intermediate transfer belt 1 (i.e., in direction X). The relation between displacement in direction X and displacement in direction Y will be described in detail in the following.

Displacement calculation in direction X and direction Y is performed on the following condition. As illustrated in FIG.

8, the center axis line S of the swing shaft 22 is to be arranged on the extension of an intersection line between a plane inclined by an angle of θ against the vertical plane passing through the center axis O of the photosensitive drum 2 and the circumference surface of the photosensitive drum 2. In addition, the transfer position T is to be on the intersection line between the lower part of the vertical plane passing through the center axis O of the photosensitive drum 2 and the circumference surface of the photosensitive drum 2. When the photosensitive drum 2 is finely rotated having the swing shaft 22 as the center, the transfer position T is moved to rotate toward arrow A or arrow B in FIG. 8.

Figure 9:
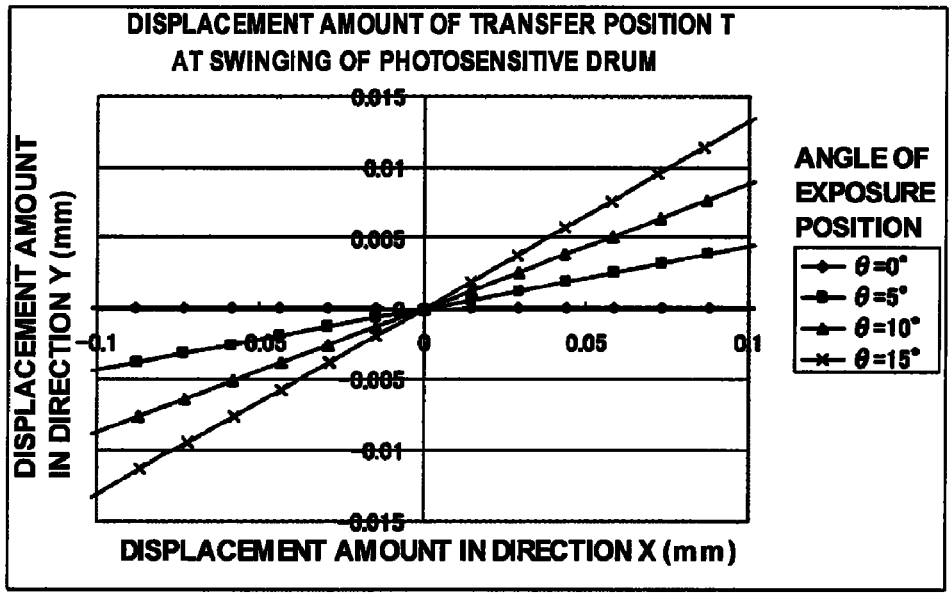
FIG. 9 is a graph which indicates a calculation result of movement amount on direction Y against movement amount in direction X of the transfer position T.

FIG. 9 is a graph indicating a calculation result of the movement amount in direction Y against the movement amount in direction X of the transfer position T. Here, the displacement amount in direction Y (i.e., the locus of the transfer position T) in the condition that the radius of the photosensitive drum 2 is 42 mm and the transfer position T is moved within a range of $-0.1\ \text{mm} \leqq X \leqq 0.1\ \text{mm}$.

As indicated in FIG. 9, the displacement amount in the vertical direction is approximately 0 μm in the case of θ=0° and is approximately ±13 μm at maximum in the case of θ=15°. Since the displacement amount is slight as described above, the effect to an image is considered to be small. However, there is a slight possibility of fluctuation of contact pressure occurring between the photosensitive drum 2 and the intermediate transfer belt 1. Therefore, it is preferable that the angle θ is set to be as small as possible.

The above description is predicated on that the center of the swing shaft 22 is aligned with the exposure position 25 of the exposure portion 9. However, there occurs a slight shifting between the exposure position 25 and the center of the swing shaft 22 due to variation of part dimensions in reality. The consideration on the effect of the shifting will be described with reference to FIGS. 10 and 11.

Figure 10:
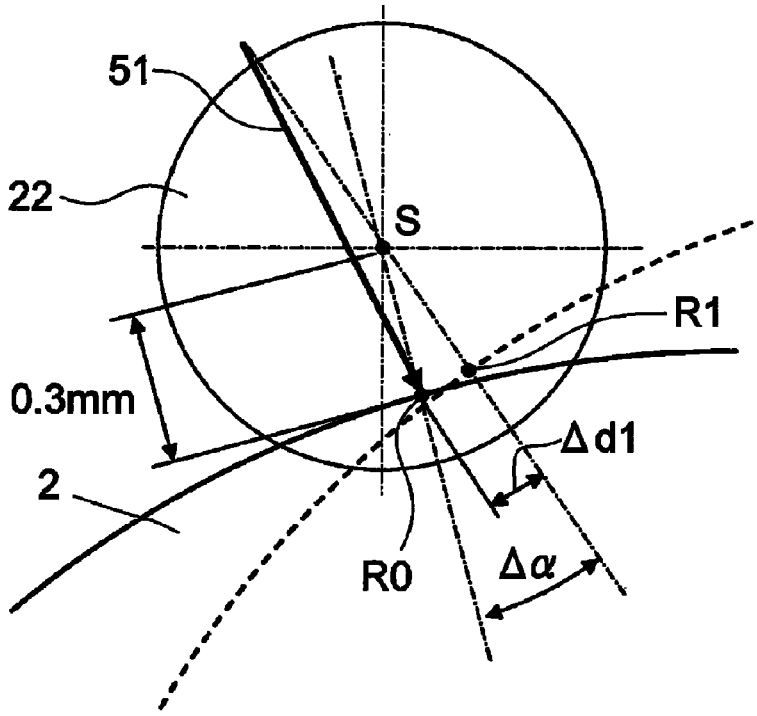
FIG. 10 is a view which illustrates a state that shifting between an exposure position and the center axis of a swing shaft occurs in the radius direction of the photosensitive drum.

FIG. 10 is a view illustrating a state that shifting between the exposure position 25 and the center axis S of the swing shaft 22 occurs in the radius direction of the photosensitive drum 2. Here, shifting of 0.3 mm is generated.

In this case, when the photosensitive drum 2 is rotated by an angle of Δα having the swing shaft 22 as the center, the position at which an image is to be recorded on the photosensitive drum 2 is moved from R0 to R1. However, since the irradiation position of the laser light 51 is not moved, there arises deviation of a distance Δd1. When the distance Δd1 is large, oscillation occurs at the position aligning control.

Similar to the described case of FIGS. 8 and 9, the angle Δα is calculated to be 0.07° at maximum on the condition that the radius of the photosensitive drum 2 is 42 mm and the transfer position T is moved within a range of $-0.1\ \text{mm} \leqq X \leqq 0.1\ \text{mm}$. The distance Δd1 in the case of Δα=0.7° is to be 0.00037 mm, namely, to be 0.37 μm.

With the method of Japanese Patent Laid-open No. 2004-145077, the exposure position is moved by the same amount of movement distance of the transfer position (i.e., to be 0.1 mm at maximum). In the present embodiment, the movement is to be only 0.37% thereof. Therefore, the possibility of oscillation occurring on position aligning control is extremely lowered.

Figure 11:
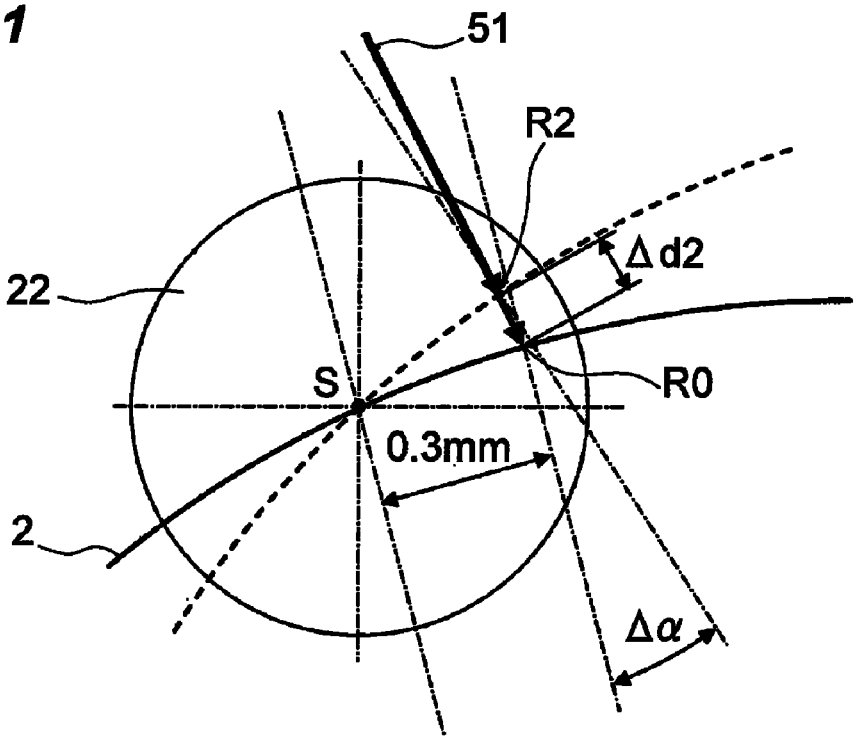
FIG. 11 is a view which illustrates a state that shifting between the exposure position and the center axis of the swing shaft occurs in the circumference direction of the photosensitive drum.

FIG. 11 is a view illustrating a state that shifting between the exposure position 25 and the center axis S of the swing shaft 22 occurs in the circumference direction of the photosensitive drum 2. Here, shifting of 0.3 mm is generated.

In this case, when the photosensitive drum 2 is rotated by an angle of Δα having the swing shaft 22 as the center, the position at which an image is to be recorded on the photosensitive drum 2 is moved from R0 to R2. Accordingly, the light path length of the laser light 51 is shortened by a distance Δd2.

When the light path length of the laser light 51 is fluctuated, the image length in the main scanning direction on the photosensitive drum 2 is fluctuated. Therefore, if the distance Δd2 is large, image deterioration is caused. Similar to the case of FIG. 10, the distance Δd2 in the case of Δα=0.7° is also calculated to be 0.00037 mm, namely, to be 0.3 mm. Here, the surface of the rotating photosensitive drum 2 fluctuates in the radius direction in the order of 10 through 30 μm due to manufacturing errors such as decentering and reflection. Even when the fluctuation of 0.37 μm at maximum is added to this fluctuation, the effect thereof is to be almost negligible.

In the present embodiment, the swing shaft 22 is arranged so that the center axis thereof is aligned to a locus position of scanning on the surface of the photosensitive drum 2 with the laser light 51 irradiated from the exposure portion 9, namely, to the extension line of the exposure position 25. Accordingly, the drum position information 53 is continuously recorded at constant intervals without variation of latent image density in the sub-scanning direction on the photosensitive drum 2. As a result, the oscillation of the position correction amount can be prevented without reference to the frequency of the speed fluctuation of the intermediate transfer belt 1. In addition, the color shifting can be prevented.

Figure 12:
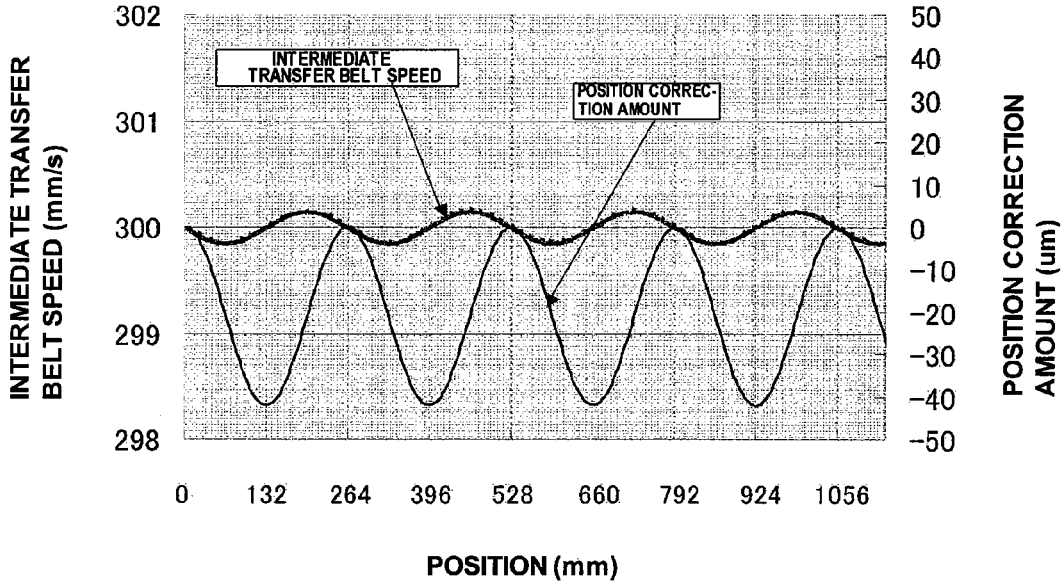
FIG. 12 is a graph which indicates a result of position correction amount according to the first embodiment.

FIG. 12 is a graph indicating the result of the position correction amount in the present embodiment. The position correction amount is calculated with the configuration of the present embodiment of FIG. 2 on the following condition. The horizontal axis is for the position (mm) on the intermediate transfer belt 1, the vertical axis of the left side is for the speed (mm/s) of the intermediate transfer belt 1, and the vertical axis of the right side is for the position correction amount (μm).

The conditions for the position correction calculation are as follows. First, the distance from the exposure position to the transfer position T is 132 mm. Regarding the photosensitive drum 2, the diameter is 84 mm and the rotation speed is 300 mm/s. In addition, regarding the speed fluctuation for the intermediate transfer belt 1, the fluctuation amount is to be ±0.05% and the cycle is the twice of the time from the exposure until the transfer. Accordingly, the intermediate transfer belt 1 receives fluctuation of 300±0.15 mm/s with the cycle of 264 mm.

As indicated in FIG. 12, it can be confirmed that oscillation does not occur on the position correction amount by adopting the present embodiment.

As described above, it is not required to cease image forming operation for preventing oscillation of the position correction amount. Further, since the configuration to swing the movable portion unit 80 by the position correction portion 7 is adopted as a configuration to finely move the photosensitive drum 2, it is not required to dispose a mechanism to integrally move the exposure portion and the photosensitive drum. In this manner, color shifting can be prevented without causing throughput decrease and apparatus upsizing.

Second Embodiment

Figure 13:
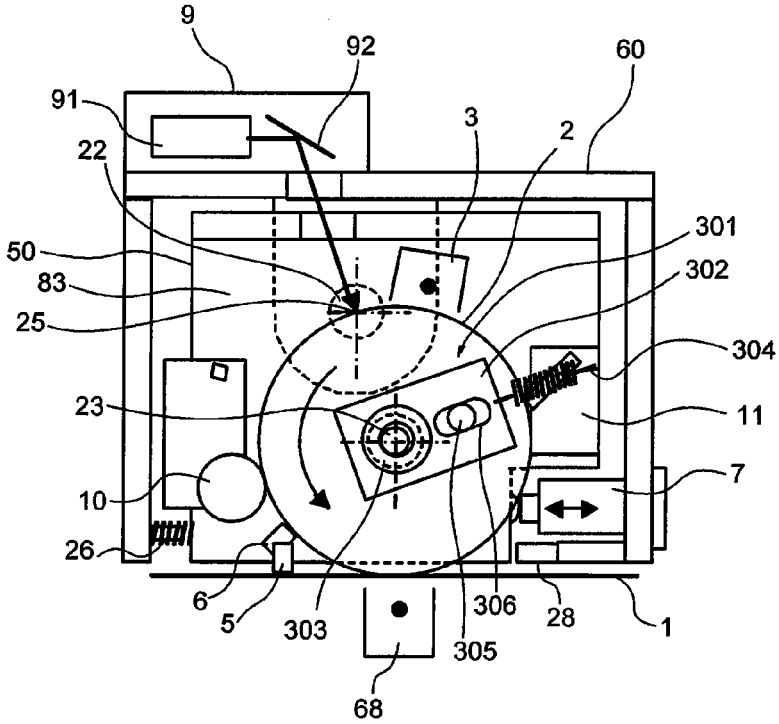
FIG. 13 is a sectional view of an image forming portion according to the second embodiment viewing from an end portion direction of the photosensitive drum.

A second embodiment will be described below with reference to FIG. 13. FIG. 13 is a sectional view of the image forming portion of the second embodiment viewing from the end portion direction of the photosensitive drum 2. The same numeral is used for the common structure to the abovementioned embodiment and the description will not be repeated. In the present embodiment, only the configuration of a drum urging portion to continuously urge the photosensitive drum 2 in one direction is differ from the embodiment of FIG. 2.

A drum urging portion 301 in the present embodiment pulls a slide plate 302 which is coupled to the photosensitive drum shaft 23 via a bearing 303 with a tension spring 304. Accordingly, the photosensitive drum 2 is urged to one direction. The drum urging portion 301 is arranged respectively to both sides of the photosensitive drum 2.

An elongated hole 306 is formed at the slide plate 302. The elongated hole 306 is engaged with a guide pin 305 arranged respectively at the movable portion left chassis 82 and the movable portion right chassis 83 and is guided movably only in the radius direction of the photosensitive drum 2.

One side of the tension spring 304 is hooked to one end of the slide plate 302 and the other side is hooked respectively to a part of the movable portion left chassis 82 and the movable portion right chassis 83.

By arranging the drum urging portion 301 of the above configuration, the photosensitive drum 2 is continuously urged to one direction and the effect due to bearing looseness of the photosensitive drum 2 is decreased. Accordingly, an even more accurate control can be performed.

Another Embodiment

In the abovementioned embodiment, the belt position information 52 on the intermediate transfer belt 1 (i.e., transfer medium position information) is previously formed at constant intervals. Further, the position correction portion 7 respectively performs position correction control of the plurality of photosensitive drums 2, so that color aligning of images transferred from respective photosensitive drums is performed. However, not limited to the above configuration, it may be considered to perform the position correction of the remaining photosensitive drums having the image on the photosensitive drum at the most upstream side as the reference.

Figure 14:
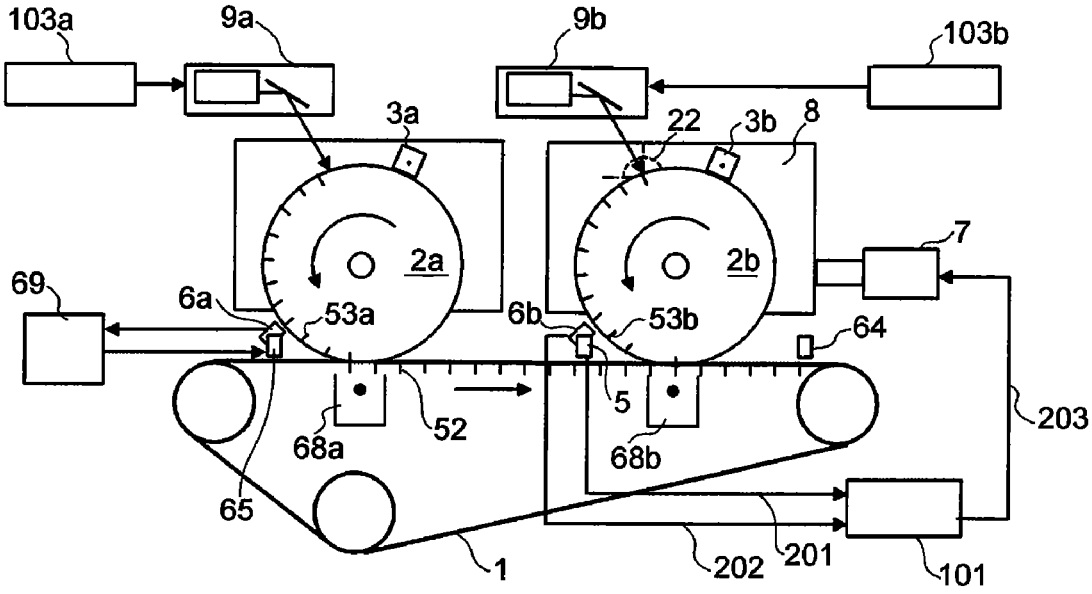
FIG. 14 is a schematic view of an image forming apparatus according to another embodiment.

A configuration of another embodiment based on such consideration will be described with reference to FIG. 14. FIG. 14 is a schematic view of an image forming apparatus of another embodiment. The same numeral is used for the common structure to the abovementioned embodiment and the description will not be repeated.

As illustrated in FIG. 14, a distinctive structure of the present embodiment is arranged at the vicinity of a first photosensitive drum 2*a* (i.e., a first photosensitive member) at the most upstream side of the photosensitive drum 2 of the present embodiment in the conveying direction of movement of the intermediate transfer belt 1.

A transcription portion 65 to record the belt position information 52 is arranged at the upstream side of the most upstream side transfer charger 68 of the first photosensitive drum 2*a*. In addition, a transcription control portion 69 to control the transcription portion 65 is arranged.

The transcription portion 65 records, with a magnetic recording head, the belt position information 52 of a binary magnetic record pattern at a magnetic recording layer formed by coating magnetic material on an area other than the image forming area of the intermediate transfer belt 1, for example.

The transcription control portion 69 controls the transcription portion 65. Specifically, using the timing of reading first drum position information 53*a* (i.e., a first photosensitive member position information) by a drum position reading portion 6*a*, the control is performed so that the first drum position information 53*a* and the belt position information 52 are aligned at a first transfer position. Then, the belt position information 52 is transcribed to the intermediate transfer belt 1.

Further, a belt position information deletion portion 64 to delete the belt position information 52 is arranged at the downstream side in the moving direction of the intermediate transfer belt 1 than a second photosensitive drum 2*b* (i.e., a second photosensitive member).

The first drum position information 53*a* is recorded at the end portion of the first photosensitive drum 2*a* at constant intervals along with a first image by a first exposure portion 9*a* which also functions as a position information recording portion. Here, the image to be recorded may be a binary magnetic pattern written by the recording magnetic head.

A drum position reading portion 6*a* (i.e., a first photosensitive member position reading portion) detects the timing of reading the first drum position information 53*a* on the first photosensitive drum 2*a*. A potential sensor to detect presence of electric charge on the surface of the first photosensitive drum 2*a* is utilized as the drum position reading portion 6*a*.

With the above configuration, the correction operation is performed as described in the following.

The belt position information 52 recorded at the intermediate transfer belt 1 is moved to the vicinity of the second photosensitive drum 2*b* in accordance with moving of the intermediate transfer belt 1. Meanwhile, second drum position information 53*b* (second photosensitive member position information) is written to the second photosensitive drum 2*b* along with a second image by a second exposure portion 9*b* which also functions as the position information recording portion. Then, when the belt position information 52 recorded at the intermediate transfer belt 1 and the second drum position information 53*b* recorded at the second photosensitive drum 2*b* are aligned at the second transfer position, the first image and the second image are to be aligned.

The belt position information 52 recorded at the intermediate transfer belt 1 and the second drum position information 53*b* recorded at the second photosensitive drum 2*b* are read respectively by the belt position reading portion 5 and the drum position reading portion 6. When the respective timings of reading of the both information are matched, there is no shifting between the belt timing information 201 of the belt position information 52 detected by the belt position reading portion 5 and the drum timing information 202 of the second drum position information 53*b* detected by the drum position reading portion 6. Accordingly, the position correction is not performed.

When the speed of the intermediate transfer belt 1 is decelerated, the belt timing information 201 is delayed against the drum timing information 202. Accordingly, the position correction calculation portion 101 converts the shifting amount of time difference between the mutual timings into the distance and transmits to the position correction portion 7 as the position correction amount 203.

The position correction portion 7 swings the movable portion unit 80 having the swing shaft 22 as the center in accordance with the shifting amount (i.e., the shifting distance) of the position correction amount 203 and moves the transfer portion of the second photosensitive drum 2*b* to the upstream side of the intermediate transfer belt 1 (i.e., the left direction in FIG. 14). In this manner, the belt position information 52 at the delaying intermediate transfer belt 1 side and the drum position information 53 of the second photosensitive drum 2*b* side are aligned.

As described above, the present embodiment includes the position correction portion to adjust the position relation between the second photosensitive member and the transfer medium so that the transfer medium position information transcribed to the transfer medium and the second photosensitive position information of the second photosensitive member are aligned. Further, the position correction of the second photosensitive member is performed by swinging the photosensitive member by the position correction portion having a line on the circumference surface of the second photosensitive drum corresponding to the exposure position of the second exposure portion as the center axis. In this manner, color shifting can be prevented without causing throughput decrease and apparatus upsizing.

Figure 15:
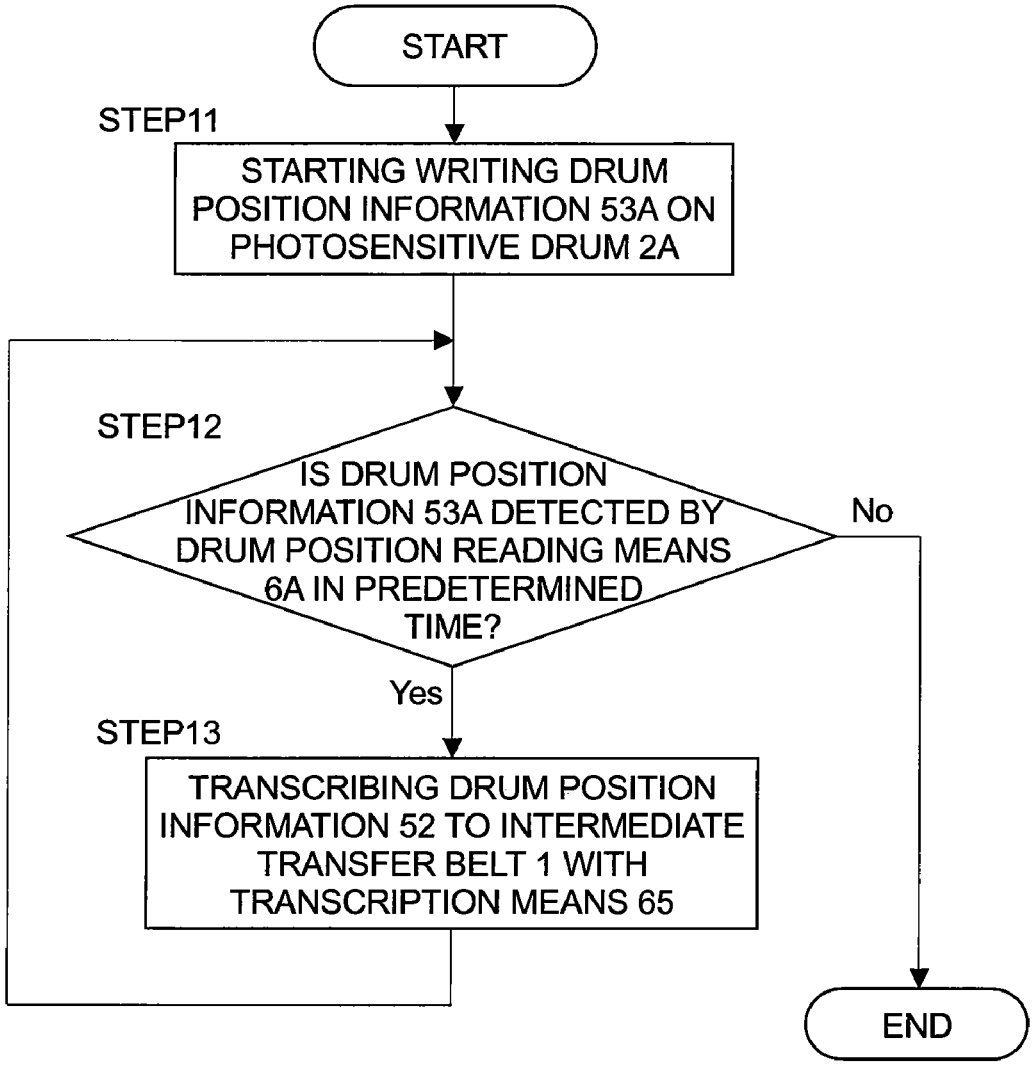
FIG. 15 is a flowchart which describes processes of a first station including a first photosensitive drum according to the other embodiment.
Figure 16:
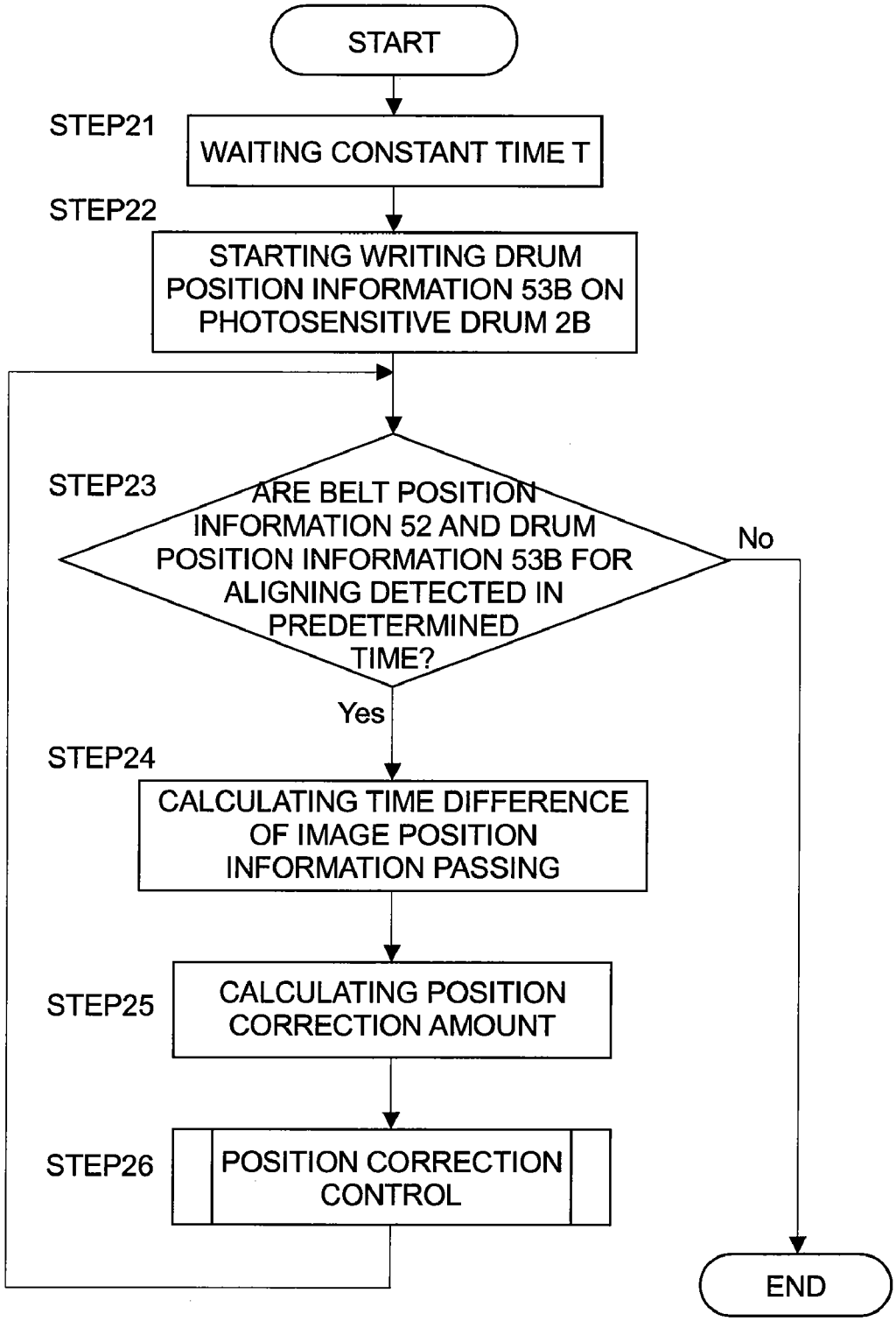
FIG. 16 is a flowchart which describes processes of a second station including a second photosensitive drum according to the other embodiment.

FIGS. 15 and 16 are flowcharts describing process flow of the present embodiment. FIG. 15 is a flowchart describing processes of a first station which includes the first photosensitive drum 2*a*. FIG. 16 is a flowchart describing processes of a second station which includes the second photosensitive drum 2*b*. It is assumed that preparations for image recording, such as transferring image data, driving of the photosensitive drum and the intermediate transfer belt are started before these processes.

At the first station, first, writing of the first drum position information 53*a* corresponding to the first image is started onto the first photosensitive drum 2*a* (STEP 11). Next, detection of the first drum position information 53*a* is performed by the drum position reading portion 6*a* (STEP 12).

When the first drum position information 53*b* is detected, the belt position information 52 is transcribed to the intermediate transfer belt 1 at the timing aligning to the first drum position information 53*b* at the transfer position (STEP 13). Subsequently, detection of the first drum position information 53*a* (STEP 12) and transcription of the belt position information (STEP 13) are repeated.

When the first drum position information 53*a* is not detected in a predetermined time in STEP 12, the first image writing is determined to be completed and the procedure is ended.

Meanwhile, at the second station, first, waiting is performed for a constant time t after starting of the first station (STEP 21). The constant time t is the time difference between image recording starting at the first station and that at the second station. The constant time t is equal to the movement time of the intermediate transfer belt 1 from the transfer position of the first station to the transfer position of the second station.

After completing the waiting, writing of the second drum position information 53*b* corresponding to the second image is started onto the second photosensitive drum 2*b* (STEP 22).

Next, detection of the belt position information 52 by the belt position reading portion 5 and detection of the second drum position information 53*b* by the drum position reading portion 6 are performed. When both of the image position information to be aligned are detected (STEP 23), the difference between passing time of the belt position information 52 and passing time of the second drum position information 53*b* is calculated (STEP 24). The position correction amount 203 is calculated from the above calculated value so as not to be shifted (i.e., so as to be aligned) at the transfer position (STEP 25).

Then, the position correction control is performed by driving the position correction portion 7 by the position correction portion driver 102 in accordance with the position correction amount 203 (STEP 26). Subsequently, the processes from STEP 23 to STEP 26 are repeated on the following image position information. In the case that the image position information is not detected in a predetermined time in STEP 23, the first image writing is determined to be completed and the procedure is ended.

The belt position information 52 recorded at the intermediate transfer belt 1 is finally deleted by the belt position information deletion portion 64 which generates an even magnetic field.

As described above, by aligning the second image position information having the first image position information on the intermediate transfer belt as the reference, the first image and the second image are superimposed and transferred accurately. In this manner, accurate color aligning can be performed. Similar to the above description, by aligning image position information at the third station and the fourth station, images of all of the colors can be aligned accurately.

In the above description, the exposure portion utilizing a laser optical system is adopted as the exposure portion of the abovementioned embodiment. However, not limited to this configuration, it is also possible to adopt another type such as an exposure portion utilizing an LED array.

In addition, in the above embodiment, the transfer medium (i.e., the image receiving member) is an intermediate transfer belt. However, not limited to this configuration, it is also possible to adopt a conveying belt which conveys the recording medium (i.e., recording paper) having the transfer medium opposing to the plurality of photosensitive drums. Further, the transfer medium is not necessarily to be belt-shaped. It is also possible to be drum-shaped.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-050429, filed Mar. 4, 2009, which is hereby incorporated by reference herein in its entirety.

What is claimed is:

1. An image forming apparatus comprising:

a plurality of image forming portions respectively including a photosensitive member, an exposure device which performs scanning exposure on the photosensitive member, and a development device which develops with toner an electrostatic image formed at the photosensitive member by the exposure device;

a transfer mechanism which transfer to an image receiving member by sequentially superimposing toner images formed at the plurality of image forming portions; and a swing mechanism which swings the photosensitive member having a main scanning line on the photosensitive member which is image-exposed by the exposure device substantially as the center axis at least at one of the image forming portions.

2. The image forming apparatus according to claim 1, further comprising a detection device which detects a predetermined electrostatic image transferred to the image receiving member from the plurality of image forming portions;

wherein the swing mechanism swings, in accordance with output of the detection device, the photosensitive member having a main scanning line on the photosensitive member which receives image-exposure from the exposure device substantially as the center axis at least at one of the image forming portions.

3. The image forming apparatus according to claim 2, wherein a line-shaped electrostatic image having predetermined intervals in a sub-scanning direction while extending in a main scanning direction is formed as the predetermined electrostatic image at the photosensitive member in the plurality of image forming portions.

4. The image forming apparatus according to claim 1, wherein the swing mechanism swings the development device integrally with the photosensitive member at least at one of the image forming portions.

5. The image forming apparatus according to claim 1, further comprising a transfer device which performs transfer from the image-receiving member to a recording sheet.

6. The image forming apparatus according to claim 1, further comprising:

a conveying member which conveys a recording sheet as the image-receiving member; and a detection device which detects a predetermined electrostatic image transferred to the conveying member from the plurality of image forming portions;

wherein the swing mechanism swings, in accordance with output of the detection device, the photosensitive member having a main scanning line on the photosensitive member which receives image-exposure from the exposure device substantially as the center axis at least at one of the image forming portions.

7. The image forming apparatus according to claim 6, wherein a line-shaped electrostatic image having predetermined intervals in a sub-scanning direction while extending in a main scanning direction is formed as the predetermined electrostatic image at the photosensitive member in the plurality of image forming portions.

* * * * *